US005876522A

United States Patent [19]

Figge et al.

[11] Patent Number: 5,876,522

[45] Date of Patent: Mar. 2, 1999

[54] PROCESS AND DEVICE FOR INLINE PICKLING OF HOT STRIPS DOWNSTREAM OF THIN-SLAB PRODUCTION INSTALLATIONS

[75] Inventors: Dieter Figge, Essen; Helmut Hümbs, Duisburg; Michael Haentjes; Rainer Lorenz, both of Essen, all of Germany

[73] Assignee: Mannesmann Aktiengesellschaft, Düsseldoff, Germany

[21] Appl. No.: 795,889

[22] Filed: Feb. 5, 1997

[30] Foreign Application Priority Data

Feb. 8, 1996 [DE] Germany ..... 196 06 305.1

[51] Int. Cl.[6] ..... C21D 5/00

[52] U.S. Cl. ..... 148/545; 148/601

[58] Field of Search ..... 266/103, 114, 266/115, 112, 111; 148/601, 545, 546, 547; 164/476, 477; 134/83

[56] References Cited

U.S. PATENT DOCUMENTS

| | | | |
|---|---|---|---|
| 4,007,750 | 2/1977 | Galloway | 134/83 |
| 5,009,396 | 4/1991 | Den Hartog et al. | 266/115 |
| 5,042,564 | 8/1991 | Van Perlstein et al. | 164/476 |

*Primary Examiner*—Scott Kastler
*Attorney, Agent, or Firm*—Cohen, Pontani, Lieberman & Pavane

[57] ABSTRACT

A process for pickling a strip which is produced in a thin slab installation and subsequently hot-rolled, especially a low-carbon steel strip, in a continuous process immediately following the rolling process. The process includes the following sequence of steps: gently cooling the strip exiting the rolling mill at ≧880° C. in a first cooling zone to 850° to 680° C., balancing surface temperature and core temperature of the strip in a first recovery zone to a uniform cross section temperature of approximately 680° C., gently cooling the strip in an immediately adjoining second cooling zone from 680° to 480° C., and balancing surface temperature and core temperature in a second recovery zone to a uniform cross section temperature of approximately 480° C. The process continues by drastically cooling the strip from 480° C. to approximately 95° C. in a third cooling zone, balancing surface temperature and core temperature in a third recovery zone to a uniform cross section temperature of approximately 100° C., guiding the strip through a number of connectable and disconnectable chemical pickling vessels at appropriately adapted pickling temperatures, the number of vessels being adapted to the thickness and/or running speed of the strip, and rinsing, drying and coiling the pickled strip.

9 Claims, 1 Drawing Sheet

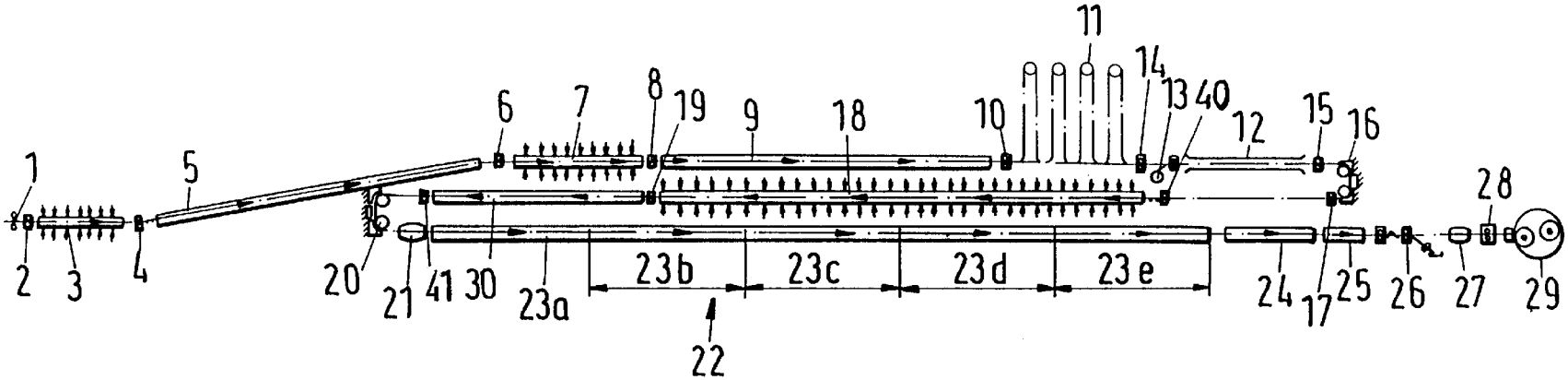
1
2
3
4
5
6
7
8
9
10
11
12
13
14
15
16
17
18
19
20
21
22
23a
23b
23c
23d
23e
24
25
26
27
28
29
30
40
41

PROCESS AND DEVICE FOR INLINE PICKLING OF HOT STRIPS DOWNSTREAM OF THIN-SLAB PRODUCTION INSTALLATIONS

BACKGROUND OF THE INVENTION

1. Field of the Invention

The invention relates to a process and an installation for pickling a strip which is produced in a thin slab installation and subsequently hot-rolled, especially a low-carbon steel strip, in a continuous process immediately following the rolling process.

2. Description of the Prior Art

For certain single-purpose products produced in large batch numbers, a coupling between a thin-slab casting installation, a hot strip rolling mill, and a pickling installation is meaningful. At the present time no such couplings are known. Underlying the idea of providing such an installation and the associated process is the fact that thin hot strip can be produced less expensively than cold strip. However, when hot strip is to be substituted for cold strip only pickled hot strip can be used, so that surface protection and coating can be applied to the finished strip without difficulty. In order to provide a meaningful connection of the casting installation, hot strip rolling mill and pickling installation, the entire installation must work inline so that all speeds must be adapted to one another while taking into account the casting process and rolling process. Duplication of installation components is to be avoided as far as possible so that the installation can be constructed at low cost and operate productively.

The chief problem in creating an installation suited to the task at hand and in implementing the work process operated therein is adapting the pickling time to the speeds determined by hot strip production. This is because the pickling arrangement must be capable of processing different strip thicknesses and speeds in an optimum manner. Pickling installations work favorably with cold strip at approximately 90° C.

A work process for pickling a strip produced in a thin slab installation and subsequently hot-rolled is meaningful when large batch numbers can be processed, low-carbon steels being especially suited for carrying out the process.

SUMMARY OF THE INVENTION

Accordingly, it is an object of the present invention to provide a process and apparatus for pickling a strip which avoids the drawbacks of the prior art processes and devices.

Pursuant to this object, and others which will become apparent hereafter, one aspect of the present invention resides in a process which includes the sequential steps of: gently cooling the strip exiting the rolling process at ≧880° C. in a first cooling zone to 850° to 680° C.; balancing surface temperature and core temperature of the strip in a first recovery zone to a uniform cross sectional temperature of approximately 680° C.; gently cooling the strip in an immediately adjoining second cooling zone from 680° to 480° C.; balancing surface temperature and core temperature of the strip in a second recovery zone to a uniform cross sectional temperature of approximately 480° C.; drastically cooling the strip from 480° C. to approximately 95° C. in a third cooling zone; balancing surface temperature and core temperature of the strip in a third recovery zone to a uniform cross sectional temperature of approximately 100° C.; guiding the strip through a number of connectable and disconnectable chemical pickling vessels at appropriately adapted pickling temperatures, the number of vessels being adapted to at least one of thickness and running speed of the strip; and rinsing, drying and coiling the pickled strip.

Due to these successive process steps, a low-carbon steel strip can be pickled inline and the speeds given by the thin-slab casting installation and the subsequent hot strip rolling mill, when correspondingly adapted, are suitable for governing the temperature control for preparing the pickling process as well as for controlling the pickling process for common thicknesses and widths of rolled product. The process can be carried out inline, i.e., a continuous pickling can be carried out subsequent to a continuous rolling of the thin-slab input stock. Martensite formation in the strip is reliably prevented in the indicated process steps by cooling the strip in a plurality of cooling zones with intermediate recovery. The drastic cooling of the strip from 480° C. to 95° C. likewise eliminates the risk of martensite formation because the transformation is concluded at 480° C., but this cooling is helpful for forming a readily soluble scale. The cold strip which is prepared in this way and is at a temperature of less than 100° C. is guided through a plurality of pickling vessels whose quantity depends on the width and thickness of the strip to be processed, the individual vessels being emptied or filled with acid via suitable pump systems as needed.

It has been shown that a strip exiting the rolling mill with a constant width of 1300 mm must be processed at determined throughput speeds which depend on the thickness and width of the strip threaded through the installation. For example, when the strip has a final thickness of 1.0 mm the final rolling speed is 4.0 m/s. When the final thickness of the strip is 1.5 mm the final rolling speed is 2.7 m/s. For a strip having an end thickness of 2.0 mm the final rolling speed is 2.0 m/s, and for a strip with an end thickness of 2.5 mm the final rolling speed is 1.6 m/s.

According to another embodiment of the invention, the work process is carried out so that, in order to introduce the strip into the processing installation, a pilot strip which has been previously threaded in is connected end to end with the start of this strip. The pilot strip, after passing through the processing installation, is wound onto one of two coiler mandrels and is severed from the strip at the end of the coiling process. The strip which is severed from the pilot strip is then wound onto the second coiler mandrel.

The threading process for pickling is seldom required, e.g., only twice a year. The pilot strip then guides the beginning of the hot strip through the pickling arrangement and is itself wound onto a mandrel of a coiler. As soon as the hot strip has been drawn through the pickling arrangement and the subsequent parts of the installation, the connection between the pilot strip and hot strip is severed and the hot strip is wound onto the second mandrel.

According to another feature of the invention, the pilot strip is removed from the first mandrel and reused for starting the next process.

After every four-hour production period, approximately, it is necessary to work up the work rolls in the hot strip rolling mill. It is also necessary to replace the immersion pipes in the thin-slab casting installation for which, as experience has shown, a break of approximately 30 minutes is required. Therefore, in a further embodiment of the work process according to the invention, the strip, which has been halted for the purpose of adjusting components of the installation, changing rolls, exchanging casting pipes in the casting installation or for repair purposes, remains in the processing installation and is used as a "pilot strip" for the next pickling action. Accordingly, the strip need not be threaded in anew by means of a separate pilot strip for a very long period of time. After a production period of approximately 4 hours, only the strip thickness is changed and the transition pieces are cut out.

A pickling installation for carrying out the work process according to the invention is characterized by the successive arrangement of the following continuously operating process components:

a) at least one cooling device with an adjoining neutralizing or compensating zone;

b) a pickling arrangement with a plurality of connectable and disconnectable pickling vessels through which the strip passes horizontally;

c) rinsing and drying devices for the pickled strip;

d) cropping shears; and e) at least two wind-up mandrels for the finished strip.

The inline arrangement of the installation components mentioned above possesses the important advantage that duplication of installation components can be avoided. Thus, the installation according to the invention has only one coiling station with two coiling mandrels, whereas individual installations would require these installation parts in duplicate. The installation can accordingly be operated in a very compact and functional manner so that large batch numbers of a certain work material can be economically processed in an optimum manner.

A loop storage and a stitching device for splicing the pilot strip with the strip to be pickled is preferably provided in the pickling installation between the cooling devices with the adjoining compensating zone and the pickling arrangement. This configuration deliberately dispenses with a welding device and its required expensive strip storage. A fast-working stitching device requiring only a short loop storage is suggested instead.

For economical application of the pulling and transporting forces required in the installation, a device for applying tensile stresses to the strip is provided on either side of the pickling arrangement. According to an advantageous embodiment of the invention, each of these devices is constructed as a circulating chain arrangement, by means of which the required transporting and pulling forces can be applied in a simple manner.

The strip widths in the pickling installation remain substantially constant with an assumed strip width of 1300 mm. The strip width can be varied within a range of ±100 mm via a trimming device provided downstream of the pickling arrangement for trimming the longitudinal edges of the pickled strip.

In a particularly advantageous embodiment of the invention, the winding mandrels are arranged on a carousel reel with a reversing mandrel and idling space. When the beginning of the hot strip is threaded through the pickling arrangement, the pilot strip is wound onto the first mandrel of the reversing coiler and the coiler reel is turned over. As soon as the beginning of the hot strip arrives, the connection between the pilot strip and hot strip is severed and the hot strip is wound onto the second mandrel of the reversing coiler.

The pickling vessels in the pickling installation are preferably turbulence pickling vessels, known per se, into which pickling acid is sprayed. The strip runs through the vessels horizontally. The vessels can be filled or emptied in a very short time via pump systems. Further, the temperature of the acid in the pickling vessels can also be controlled to adapt to different pickling tasks.

Various driving means provided in the pickling installation provide for transporting the strip through the entire installation.

The pickling installation can be realized in a particularly advantageous way, according to a preferred embodiment of the invention, in that the process components of the pickling installation are arranged in at least three planes one above the other, the strip which is deflected twice by 180° being guided therein. This provides a very compact construction of the installation. When the selected distances between the individual levels are suitably large, e.g., 4 meters, the strip is only subjected to stresses in the elastic range.

The object of coupling a thin-slab continuous casting installation, a hot strip rolling mill and a pickling installation for the production of thin hot strips is met by the present invention in a surprisingly simple manner. The installation is particularly suitable for processing low-carbon steels (e.g., ST 37, ST 52 and ST 10) which can be produced economically in large batches. The installation is compact, simply constructed and also inexpensive to produce since substantial installation components are required only once as a result of the inline process. Handling of the installation is simple and dependable so that a good cost-to-performance ratio can be expected.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The single FIGURE schematically illustrates the inventive pickling apparatus.

DETAILED DESCRIPTION OF THE PREFERRED EMBODIMENTS

The drawing shows the final stand 1 of a hot strip rolling mill which is arranged immediately subsequent to a thin-slab casting installation. The stand 1 rolls out the thin slab into a strip with final dimensions ranging from 2.5 mm to 1 mm. A cooling device 3, with the intermediary of a driver 2 for the strip, adjoins the hot strip rolling mill. The strip is gently cooled from approximately 850° C. to 680° C. in the cooling device 3. A first compensating zone 5 with a length of 38 m is provided on the delivery side of the cooling device 3, which is followed by a roll driver 4. The strip maintains a temperature of 680° C. along its entire cross section in this compensating zone 5 as a result of the balancing of the external and internal temperature. Following the compensating zone 5 is another driver 6 for the strip which transports the strip to another cooling zone 7 for a gentle cooling of the strip from 680° C. to 480° C. At 480° C. the strip is introduced into a second compensating zone 9 with the assistance of another driver 8. In this zone 9, the strip cross section is provided with a uniform temperature of 480° C. The strip is then guided, with the assistance of another driver 10, into a loop storage 11 in which the strip is guided in a known manner in a plurality of loops around rollers whose spacing from one another can be altered. At the outlet of the loop storage 11 is a stitching device 12 in which the beginning of the strip can be connected by stitching with the end of a pilot strip 13. Shears 14, in which the beginning of the strip can be sheared square, are arranged ahead of the stitching device 12. With the assistance of another driver 15, the strip exits the stitching device 12, whose operation will be described below, and is guided back 1800 at a deflection roller assembly 16 into a second level in the direction opposite to the previous strip running direction.

Once again assisted by drivers 17, 40 after the deflection, the strip enters a third cooling zone 18 where it is very drastically cooled from 480° C. to 95° C. Once again with the assistance of a driver 19, the cooled strip arrives in a third compensating zone 30 having a length of approximately 25 m, in which the temperature of approximately 95 ° C. is made uniform over the entire cross section of the strip. A further driver 41 drives the strip from the outlet of the third compensating zone 30 to a deflection roller assembly 20. At the deflection roller assembly 20, the strip is again deflected by 180° in its running direction and is then driven by a blocking chain stand 21 into a pickling installation 22. The pickling installation 22 is formed of a total of five pickling vessels 23*a*–23*e*, each having a length of 18 m. The pickling vessels 23*a*–23*e* are constructed as turbulence pickling devices with a horizontal throughput for the strip. The pickling vessels 23*a*–23*e* can be filled with acid and emptied, as required, via pump systems which are not shown in the drawing.

Following the pickling installation 22, the strip is rinsed in a known manner in a rinsing device 24 and dried in a drying device 25. If necessary, the edges of the strip are then trimmed with trimming shears 26. A second blocking chain or circulating chain stand 27 is arranged at the delivery or output side of the pickling installation 22. The necessary strip tension can be applied between the first and second circulating chain stands 21 and 27, respectively. The installation terminates with rotary trimming shears 28 and a reversing coiler 29 in which the finished strip or pilot strip can be coiled.

As was already indicated in the general description of the invention, the strip is threaded into the pickling arrangement by means of a pilot strip 13 which is coiled up, extends along the installation and is connected with the beginning of the strip in the stitching device 12. The pilot strip, along with the stitched on strip, is drawn through the entire installation, including the pickling installation 22, and is coiled up on a first coiler mandrel of the reversing coiler 29 at the end of the installation. As soon as the beginning of the strip reaches the region of the reversing coiler 29, this strip is severed from the pilot strip and guided to a second coiler mandrel of the reversing coiler 29. The pilot strip can be uncoiled and returned for the next threading process, while the hot strip is wound up on the reversing coiler in a known manner. A metal woven strip with good flexibility which does not require large forces to be guided around the 180-degree deflections is advisably used as the pilot strip.

The entire installation in its preferred embodiment has a length of 178 m between the last stand 1 of the hot strip rolling mill and the reversing coiler 29. This compact construction can be achieved in that the entire installation is arranged in three levels at a distance from one another of 4 m in each instance. The first cooling zone 3 at a length of 10 m enables cooling at the following speeds: a final rolling speed of 4.0 m/s for a final strip thickness of 1 mm; a final rolling speed of 2.7 m/s for a final strip thickness of 1.5 mm; a final rolling speed of 2.0 m/s for a final strip thickness of 2.0 mm; and a final rolling speed of 1.6 m/s for a final strip thickness of 2.5 mm. The compensating zone 5 with a length of 38 m leads to the indicated temperatures. The second cooling zone 7 with a length of 15 m is followed by the second output zone which likewise has a length of 38 m. Each pickling vessel 23 is 18 m which has proven adequate for pickling even the thickest strip to be produced in the installation.

With an installation of this kind, it is possible for the first time to operate a continuous inline process with casting, rolling and pickling of thin slabs and, accordingly, to produce a commercial hot strip in large batch numbers and, in the most advantageous manner, with low-carbon steel grades. Any known arrangement of shaping stands for shaping thin slabs can be used as rolling mill, e.g., also a so-called planetary roll stand (Sendzimir type or Platzer type design).

The invention is not limited by the embodiments described above which are presented as examples only but can be modified in various ways within the scope of protection defined by the appended patent claims.

I claim:

1. A process for pickling a strip which is produced in a thin slab installation and subsequently hot-rolled, in a continuous process in a processing installation immediately following a rolling process, comprising the sequential steps of:

gently cooling the strip exiting the rolling process at ≧880° C. in a first cooling zone to 850° to 680° C.;

balancing surface temperature and core temperature of the strip in a first recovery zone to a uniform cross sectional temperature of approximately 680° C.;

gently cooling the strip in an immediately adjoining second cooling zone from 680° to 480° C.;

balancing surface temperature and core temperature of the strip in a second recovery zone to a uniform cross sectional temperature of approximately 480° C.;

drastically cooling the strip from 480° C. to approximately 95° C. in a third cooling zone;

balancing surface temperature and core temperature of the strip in a third recovery zone to a uniform cross sectional temperature of approximately 100° C.;

guiding the strip through a number of connectable and disconnectable chemical pickling vessels at appropriately adapted pickling temperatures, the number of vessels being adapted to at least one of thickness and ruling speed of the strip; and rinsing, drying and coiling the pickled strip.

2. A process for pickling a strip according to claim 1, wherein the rolled strip has a substantially constant width of 1300 mm, and further including adapting final rolling speeds of the strip and accordingly its throughput speeds in the processing installation to a final thickness of the rolled strip.

3. A process for pickling a strip according to claim 2, wherein the rolled strip has an end thickness of 1.0 mm and the final rolling speed is 4.0 m/s.

4. A process for pickling a strip according to claim 2, wherein the rolled strip has an end thickness of 1.5 mm and the final rolling speed is 2.7 m/s.

5. A process for pickling a strip according to claim 2, wherein the rolled strip has an end thickness of 2.0 mm and the final rolling speed is 2.0 m/s.

6. A process for pickling a strip according to claim 2, wherein the rolled strip has an end thickness of 2.5 mm and the final rolling speed is 1.6 m/s.

7. A process for pickling a strip according to claim 1, and further comprising the steps of connecting a previously threaded-in pilot strip end to end with a start of the strip for introducing the strip into the processing installation, winding the pilot strip, after passing through the processing installation, onto a first of two coiler mandrels, and severing the pilot strip from the pickled strip when the pilot strip is coiled, the pickled strip coiling step including winding the pickled strip which is severed from the pilot strip onto a second of the two coiler mandrels.

8. A process for pickling a strip according to claim 7, and further comprising the step of reusing the coiled pilot strip for the connecting step.

9. A process for pickling a strip according to claim 1, including maintaining a strip which has been halted during adjustment of plant components, in the processing installation and using the strip as a pilot strip for a next pickling action.

* * * * *